US009463631B2

(12) United States Patent
Tanda

(10) Patent No.: US 9,463,631 B2
(45) Date of Patent: Oct. 11, 2016

(54) INK-JET RECORDING APPARATUS

(71) Applicant: KYOCERA Document Solutions Inc., Osaka (JP)

(72) Inventor: Tetsuo Tanda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 27 days.

(21) Appl. No.: 14/821,326

(22) Filed: Aug. 7, 2015

(65) Prior Publication Data

US 2016/0046128 A1 Feb. 18, 2016

(30) Foreign Application Priority Data

Aug. 18, 2014 (JP) ..... 2014-165871
Jun. 22, 2015 (JP) ..... 2015-124761

(51) Int. Cl.
*B41J 2/165* (2006.01)

(52) U.S. Cl.
CPC ..... *B41J 2/16538* (2013.01); *B41J 2/16544* (2013.01); *B41J 2/16547* (2013.01); *B41J 2/16585* (2013.01)

(58) Field of Classification Search
CPC ..... B41J 2/16535; B41J 2/16542; B41J 2/16538; B41J 2/16544
USPC ..... 347/33
See application file for complete search history.

(56) References Cited

U.S. PATENT DOCUMENTS

2011/0043568 A1* 2/2011 Heo ..... B41J 2/16538 347/33
2014/0184690 A1* 7/2014 Miyamoto ..... B41J 2/16523 347/30

FOREIGN PATENT DOCUMENTS

JP 2006-27002 A 2/2006

* cited by examiner

*Primary Examiner* — Jason Uhlenhake
(74) *Attorney, Agent, or Firm* — Stein IP, LLC

(57) ABSTRACT

An ink-jet recording apparatus according to the present disclosure includes a recording portion, a wipe unit, a cleaning mechanism, a wipe moving-up/down mechanism, a transfer surface moving mechanism, and a control portion. The wipe unit has a wipe blade that wipes purged ink that is forcibly discharged from an ejecting nozzle. The cleaning mechanism has a cleaning member onto which ink adhering to a tip end surface of the wipe blade is transferred. The control portion controls the wipe moving-up/down mechanism to force the wipe blade to repeat contacting and leaving a plurality of times the transfer surface of the cleaning member substantially vertically to remove the ink present on the tip end surface of the wipe blade, and controls the transfer surface moving mechanism in such a manner that the tip end surface of the wipe blade contacts a clean portion of the transfer surface.

10 Claims, 16 Drawing Sheets

INK-JET RECORDING APPARATUS

INCORPORATION BY REFERENCE

The present application is based on and claims the benefit of priority from Japanese Patent Application No. 2014-165871 filed on Aug. 18, 2014 and No. 2015-124761 filed on Jun. 22, 2015, the contents of which are hereby incorporated by reference.

BACKGROUND OF THE INVENTION

The present disclosure relates to an ink-jet recording apparatus that performs recording by ejecting ink onto a recording medium such as a paper sheet.

Recording apparatuses such as facsimiles, copy machines, printers and the like are structured to record an image onto recording mediums such as paper sheets, OHP sheets and the like, and depending on recording types, can be classified into an ink-jet type, a wire dot type, a thermal type and the like. Besides, the ink-jet recording type can be classified into a serial type in which a recording head scans a recording medium to perform recording and a line head type which performs recording by means of a recording head that is fixed to an apparatus main body.

An ink-jet recording apparatus of the serial type includes a recording head that ejects ink while scanning the recording medium in a direction perpendicular to a conveyance direction of the recording medium. On the other hand, an ink-jet recording apparatus of the line head type includes ink-jet heads (recording heads) of the line head type for every color in which ejecting nozzles are arranged at predetermined intervals across an entirety of a printing regional width perpendicular to the conveyance direction of the recording medium. And, by ejecting ink from an ejecting nozzle corresponding to a printing position in synchronization with conveyance of the recording medium, it is possible to perform printing on the entire recording medium.

In such ink-jet recording apparatuses, usually, a recovery process is performed in which thickened ink in the ejection nozzle is forcibly pushed out periodically from an ejecting opening of the recording head. In the recovery process, for example, the ink is forcibly pushed out (purged) from the ejecting opening of the recording head, thereafter, the purged ink on an ink ejecting surface is wiped by a wipe blade. At this time, the purged ink adheres to a tip end surface and side surface of the wipe blade. And, the wipe blade is reciprocated in a horizontal direction and thereby the ink on the wipe-blade tip end is rubbed against an ink removal plate from both left and right sides. In this method, the ink on the wipe blade can be removed to some extent.

SUMMARY OF THE INVENTION

An ink-jet recording apparatus according to an aspect of the present disclosure includes a recording portion, a wipe unit, a cleaning mechanism, a wipe moving-up/down mechanism, a transfer surface moving mechanism, and a control portion. The recording portion has a recording head provided with a nozzle region from which an ejecting nozzle for ejecting ink onto a recording medium is opened. The wipe unit has a wipe blade that wipes purged ink that is forcibly discharged from the ejecting nozzle. The cleaning mechanism has a cleaning member having a transfer surface to which ink adhering to a tip end surface of the wipe blade is transferred. The wipe moving-up/down mechanism moves the wipe blade. The transfer surface moving mechanism moves a transfer surface. The control portion is capable of: controlling the wipe moving-up/down mechanism to execute an ink removal step in which the wipe blade repeats a plurality of times contacting and leaving substantially vertically the transfer surface of the cleaning member to remove the ink on the tip end surface of the wipe blade; and controlling the transfer surface moving mechanism to execute a transfer surface moving step in which the transfer surface moves in such a manner that the tip end surface of the wipe blade contacts a clean portion of the transfer surface.

Still other objects of the present disclosure, and specific advantages obtained by the present disclosure will become more apparent from the following description of embodiments.

DETAILED DESCRIPTION OF THE EMBODIMENTS

Hereinafter, embodiments of the present disclosure are described with reference to the drawings.

Figure 1:
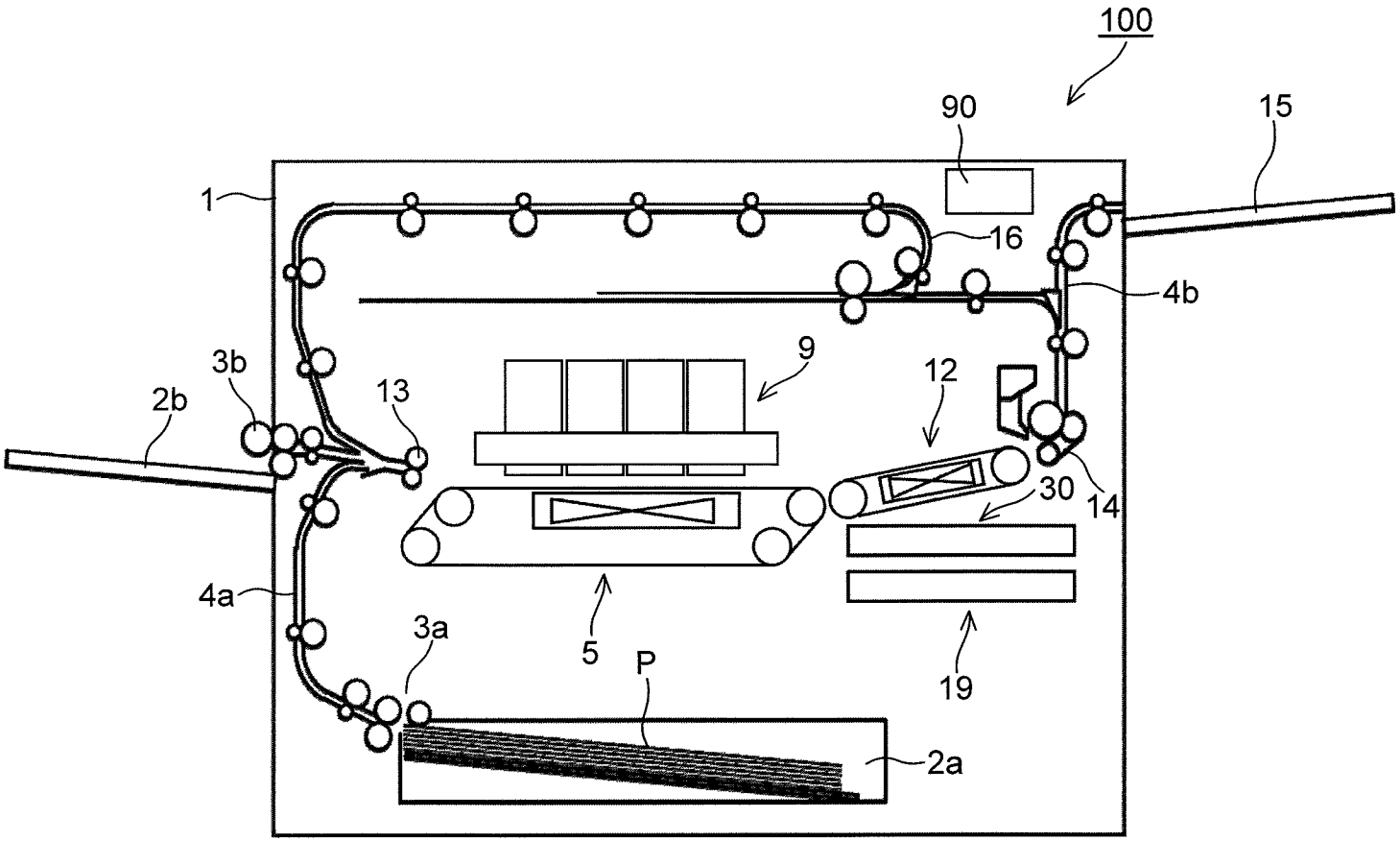
FIG. 1 is a side cross-sectional view showing a structure of a printer according to an embodiment of the present disclosure.

With reference to FIG. 1 to FIG. 29, a printer 100 of the ink-jet type (ink-jet recording apparatus) according to an embodiment of the present disclosure is described. As shown in FIG. 1, in the printer 100, an internal lower portion of a printer main body 1 is provided with a sheet feeding cassette 2*a* as a sheet storage portion. Sheets P such as cut paper and the like before printing as an example of a recording medium are stored in the sheet feeding cassette 2*a*. A sheet feeding device 3*a* is disposed in a downstream side of the sheet feeding cassette 2*a* in a sheet conveyance direction, namely, in a left upper portion of the sheet feeding cassette 2*a* in FIG. 1. The sheets P are separated and sent out one after another by the sheet feeding device 3*a* toward the left upper direction from the sheet feeding cassette 2*a* in FIG. 1. The sheet feeding cassette 2*a* can be drawn out horizontally from a front side of the printer main body 1 to supply the sheets P.

A manual sheet feeding tray 2*b* is disposed outside a left side surface of the printer main body 1. The manual sheet feeding tray 2*b* is loaded with sheets having a size different from the sheet P in the sheet feeding cassette 2*a*, sheets having difficulty in passing through a bent conveyance path, or sheets to be manually fed one after another. A sheet feeding device 3*b* is disposed in a downstream side of the manual sheet feeding tray 2*b* in a sheet conveyance direction, namely, on the right side of the manual sheet feeding tray 2*b* in FIG. 1. The sheets on the manual sheet feeding tray 2*b* are separated and sent out one after another by the sheet feeding device 3*b* to a right portion in FIG. 1.

Besides, the printer 100 includes therein a first sheet conveyance path 4*a*. The first sheet conveyance path 4*a* is located in the left upper direction as the sheet conveyance direction with respect to the sheet feeding cassette 2*a*, and located in a right side with respect to the manual sheet feeding tray 2*b*. The sheet P sent out from the sheet feeding cassette 2*a* passes the first sheet conveyance path 4*a* and is conveyed vertically upward along a side surface of the printer main body 1, and the sheet sent out from the manual sheet feeding tray 2*b* is conveyed to the right substantially horizontally.

A registration roller pair 13 is disposed at a downstream end portion of the first sheet conveyance path 4*a* in the sheet conveyance direction. Further, a first belt conveyance portion 5 and a recording portion 9 are disposed very close to the registration roller pair 13 on the downstream side in the sheet conveyance direction. The sheet P sent out from the sheet feeding cassette 2*a* (or manual sheet feeding tray 2*b*) passes through the first sheet conveyance path 4*a* to reach the registration roller pair 13. The registration roller pair 13 corrects an oblique conveyance of the sheet P and sends out the sheet P to the first belt conveyance portion 5 at a timing synchronized with an ink ejecting operation executed by the recording portion 9.

Besides, to prevent defective ink ejecting caused by drying or clogging of a recording head, the recording portion 9 performs purging to push out highly viscous ink present in ejecting nozzles from the ejecting nozzles of all the recording heads at a printing start time after a long-time stop and from an ejecting nozzle whose ink ejecting amount is equal to or less than a standard value between printing operations, thereby preparing for the next printing operation.

A second belt conveyance portion 12 is disposed in a downstream side (right side of FIG. 1) of the first belt conveyance portion 5 in the sheet conveyance direction. The sheep P, on which an ink image is recorded by the recording portion 9, is sent to the second belt conveyance portion 12, and the ink ejected to a surface of the sheet P is dried during the passing through the second belt conveyance portion 12.

A decurler portion 14, namely, a curl corrector, is disposed in a downstream side of the second belt conveyance portion 12 in the sheet conveyance direction and near a right side surface of the printer main body 1. The sheet P, whose ink is dried on the second belt conveyance portion 12, is sent to the decurler portion 14, where a curl of the sheet P is corrected by using a plurality of rollers arranged in a sheet width direction.

A second sheet conveyance path 4*b* is disposed in a downstream side (upper portion of FIG. 1) of the decurler portion 14 in the sheet conveyance direction. In a case where both-side recording is not performed on the sheet P passing through the decurler portion 14, the sheet P is discharged from the sheet conveyance path 4*b* onto a sheet discharge tray 15 disposed outside the right side surface of the printer 100 via a discharge roller pair.

A reverse conveyance path 16 used for performing both-side recording is disposed in an upper portion of the printer main body 1 and above the recording portion 9 and the second belt conveyance portion 12. In a case where the both-side recording is performed, the sheet P, which undergoes recording on a first surface and passes through the second belt conveyance portion 12 and the decurler portion 14, is sent to the reverse conveyance path 16 through the second sheet conveyance path 4*b*. The sheet P sent to the reverse conveyance path 16 is thereafter changed in the conveyance direction for recording on a second surface to pass through the upper portion of the printer main body 1, passes through the upper portion of the printer main body 1 to be sent to the left side, passes through the first sheet conveyance path 4*a* and the registration roller pair 13, and sent again to the first belt conveyance portion 5 with the second surface facing upward.

Besides, a wipe unit 19 and a cap unit 30 are disposed below the second belt conveyance portion 12. When performing the above purging, the wipe unit 19 moves horizontally under the recording portion 9, wipes the ink ejected from the ejecting nozzles of the recording head, and collects the wiped ink. When capping the ink ejecting surface of the recording head, the cap unit 30 moves horizontally under the recording portion 19, further moves upward to be mounted on a lower surface of the recording head.

Figure 2:
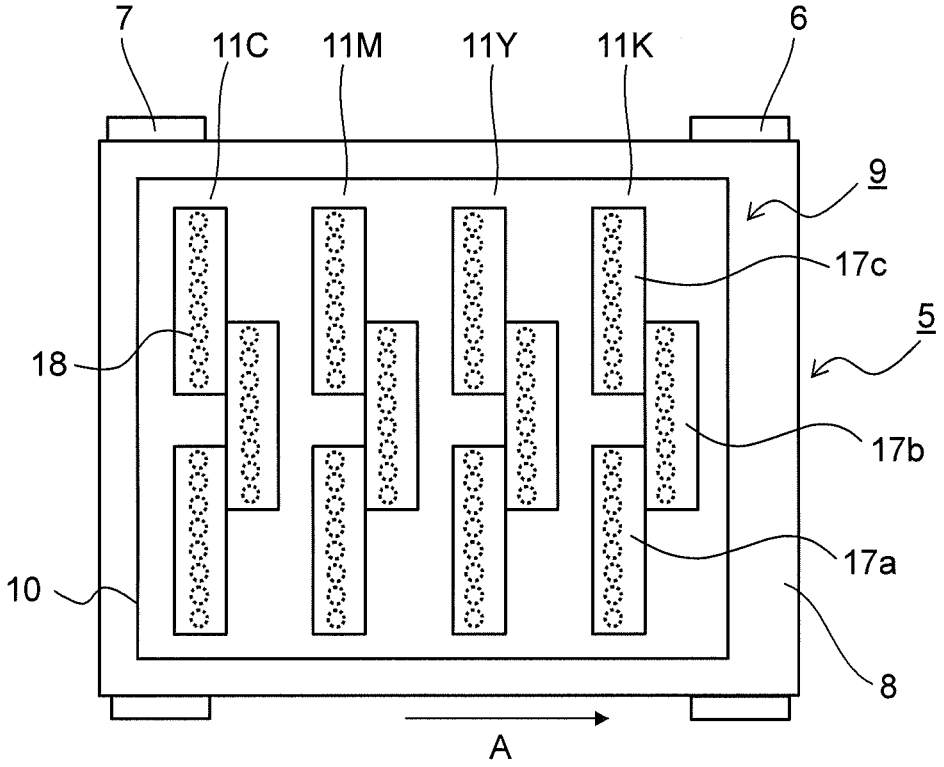
FIG. 2 is a plan view showing, from above, a first belt conveyance portion and a recording portion of the printer according to the embodiment of the present disclosure.
Figure 3:
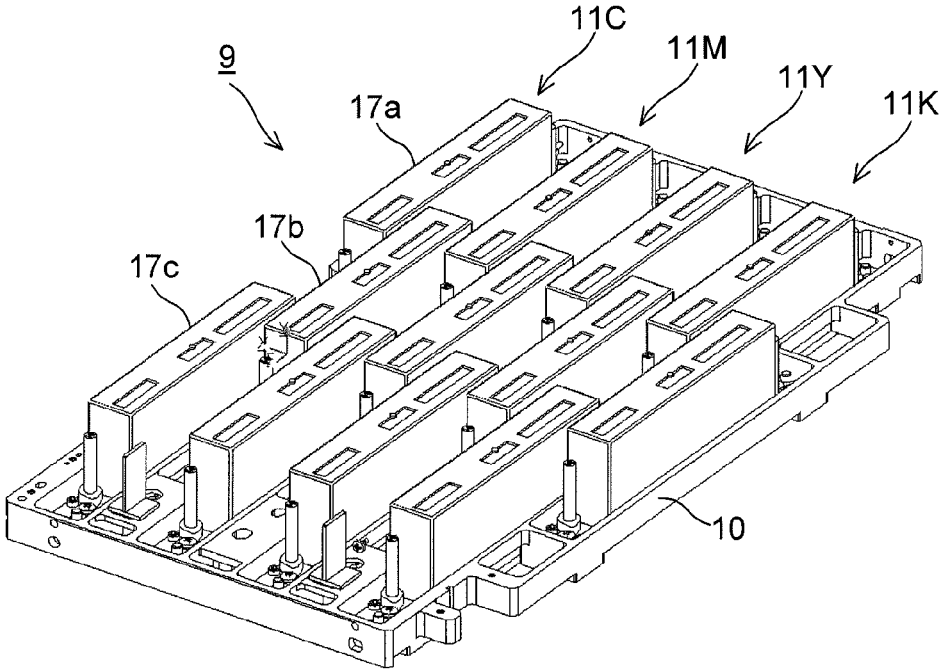
FIG. 3 is a perspective view showing a structure of the recording portion of the printer according to the embodiment of the present disclosure.
Figure 4:
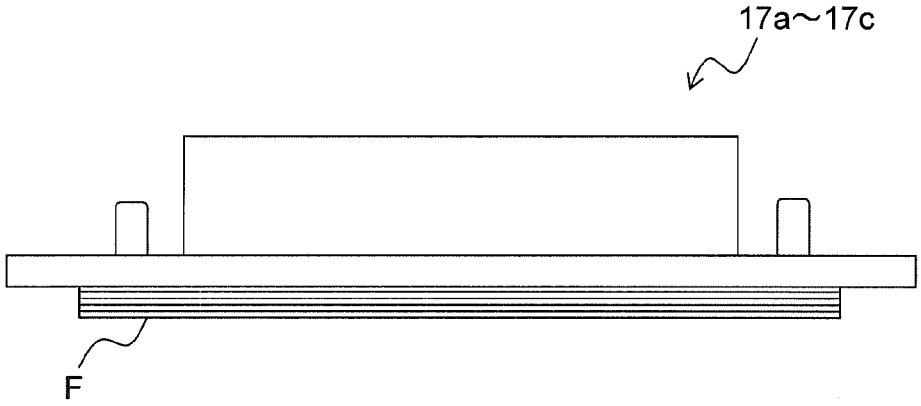
FIG. 4 is a side view showing a structure of a recording head that composes a line head of the recording portion of the printer according to the embodiment of the present disclosure.

As shown in FIG. 2 and FIG. 3, the recording portion 9 includes a head housing 10, and line heads 110, 11M, 11Y, and 11K held by the head housing 10. These line heads 11C-11K are supported at a height to form a predetermined distance (e.g., 1 mm) from a conveyance surface of a first conveyance belt 8 wound around a plurality of rollers including a drive roller 6 and a driven roller 7, and has a plurality of recording heads 17*a*-17*c* (here, three) that are disposed in a staggering manner along the sheet width direction (vertical direction of FIG. 2) perpendicular to the sheet conveyance direction. The line heads 11C-11K have a recording region larger than the width of the conveyed sheet P, and can eject ink from an ejecting nozzle 18 corresponding to a printing position onto the sheet P conveyed on the first conveyance belt 8.

Figure 5:
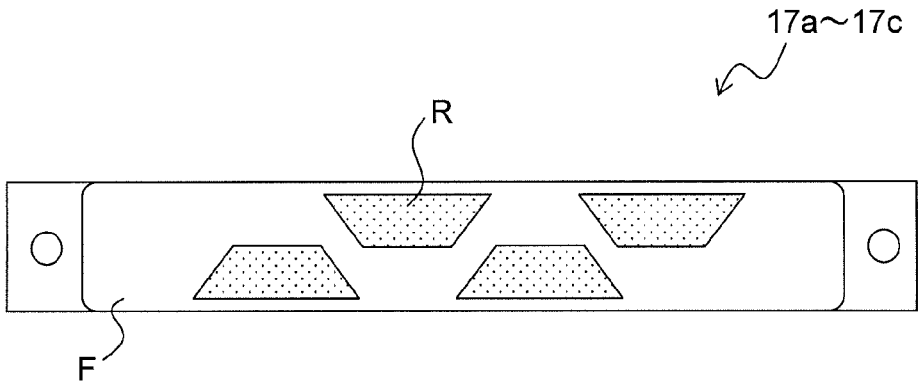
FIG. 5 is a bottom view showing, from an ink ejecting surface side, the recording head of the printer according to the embodiment of the present disclosure.

As shown in FIG. 5, an ink ejecting surface F (see FIG. 4) of each recording head 17*a*-17*c* is provided with nozzle regions R where many ejecting nozzles 18 are arranged. In the meantime, because the recording heads 17*a*-17*c* have the same shape and structure, the recording heads 17*a*-17*c* are shown by using one drawing in FIG. 4 and FIG. 5. Besides, as shown in FIG. 2 and FIG. 3, in the three recording heads 17*a*-17*c* composing the same line heads 11C-11K, the ejecting nozzles 18 disposed in the respective recording heads 17*a*-17*c* are partially deviated to overlap each other at end portions in the sheet conveyance direction.

Figure 6:
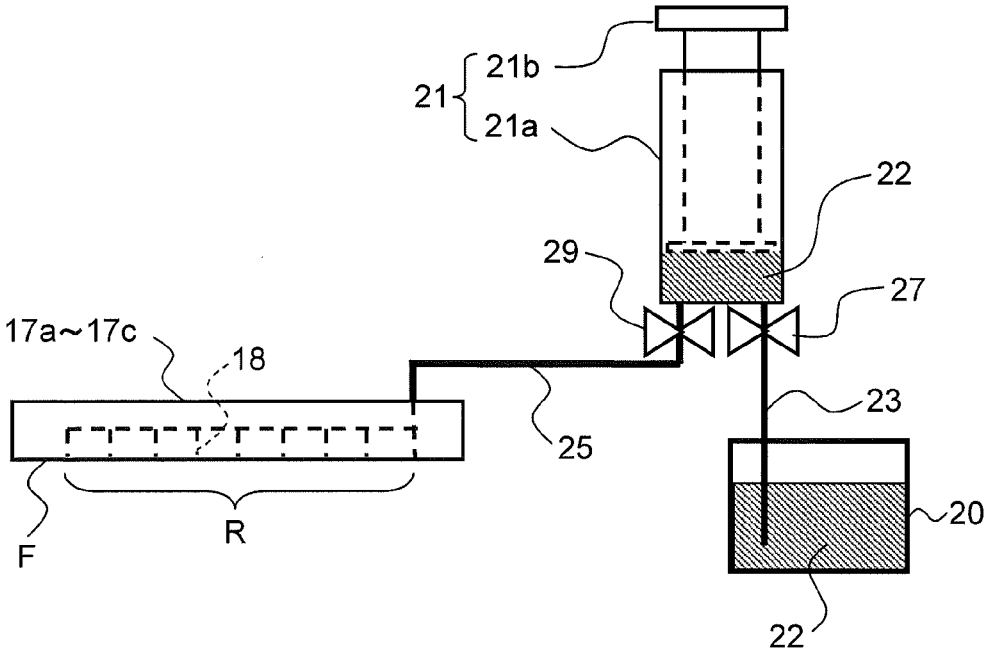
FIG. 6 is a view showing an ink flow path from an ink tank to the recording head of the printer according to the embodiment of the present disclosure.

The groups of the recording heads 17*a*-17*c* composing each line head 11C-11K are respectively supplied with four different color inks (cyan, magenta, yellow, and black) that are respectively stored in ink tanks 20 (see FIG. 6).

In accordance with image data received from an external computer and the like, each recording head 17*a*-17*c* ejects ink from the ejecting nozzles 18 onto the sheet P conveyed with attracted and held by the conveyance surface of the first conveyance belt 8. In this way, a color image composed of the mixed four color inks of cyan, magenta, yellow and black is formed on the sheet P on the first conveyance belt 8.

Besides, to prevent defective ink ejecting caused by drying or clogging of the recording heads 17*a*-17*c*, purging to push out highly viscous ink located in ejecting nozzles from the ejecting nozzles 18 of all the recording heads 17*a*-17*c* at a printing start time after a long-time stop and purging to push out highly viscous ink from some of the ejecting nozzles 18 of the recording heads 17*a*-17*c* whose ink ejecting amounts are equal to or less than a standard value between printing operations are performed to prepare for the next printing operation.

In the meantime, as methods for ejecting the ink from the recording heads 17*a*-17*c*, for example, it is possible to employ various methods such as a piezoelectric method for pushing out the ink by using a not-shown piezoelectric element, a method for ejecting the ink by producing air bubbles by using a heat generating material and exerting pressure on the ink and the like.

Thereafter, the ink supply during a printing period from the ink tank 20 to the recording heads 17*a*-17*c* and the ink discharge during a purge period from the recording heads 17*a*-17*c* are described. In the meantime, an ink flow path shown in FIG. 6 is disposed between each ink tank 20 and the recording heads 17*a*-17*c*, but here, an ink flow path for an arbitrary color is described.

As shown in FIG. 6, a syringe pump 21 is disposed between the ink tank 20 and the recording heads 17*a*-17*c*. The ink tank 20 and the syringe pump 21 are connected to each other by a first supply path 23 formed of a tube member, and the syringe pump 21 and the ejecting nozzles 18 of the recording heads 17*a*-17*c* are connected to each other by a second supply path 25 formed of a tube member.

The first supply path 23 is provided with an inlet valve 27, and the second supply path 25 is provided with an outlet valve 29. By opening and closing the inlet valve 27, the movement of ink in the first supply path 23 is allowed or restrained, and by opening and closing the outlet valve 29, the movement of ink in the second supply path 25 is allowed or restrained.

The syringe pump 21 includes a cylinder 21*a* and a piston 21*b*. The cylinder 21*a* is connected to the first supply path 23 and the second supply path 25, and the ink in the ink tank 20 flows into the cylinder 21*a* through the first supply path 23. Besides, the ink is discharged from the cylinder 21*a* through the second supply path 25, and the discharged ink is supplied to the recording heads 17*a*-17*c* to be pushed out from the ejecting nozzles 18 onto the nozzle regions R of the ink ejecting surfaces F.

The piston 21*b* is vertically movable by a drive device (not shown). A packing (not shown) such as an O-ring or the like is mounted on an outer circumference of the piston 21*b* to prevent an ink leak from the cylinder 21*a*, and make the piston 21*b* slide smoothly along an inner circumference surface of the cylinder 21*a*.

During a usual period (printing period), as shown in FIG. 6, both the inlet valve 27 and the outlet valve 29 are in an open state, and by holding the piston 21*b* at a predetermined position, a substantially constant amount of ink is hold in the cylinder 21*a*. And, the ink 22 is supplied from the cylinder 21*a* to the recording heads 17*a*-17*c* by surface tension difference (meniscus) between the cylinder 21*a* and the recording heads 17*a*-17*c*.

Figure 7:
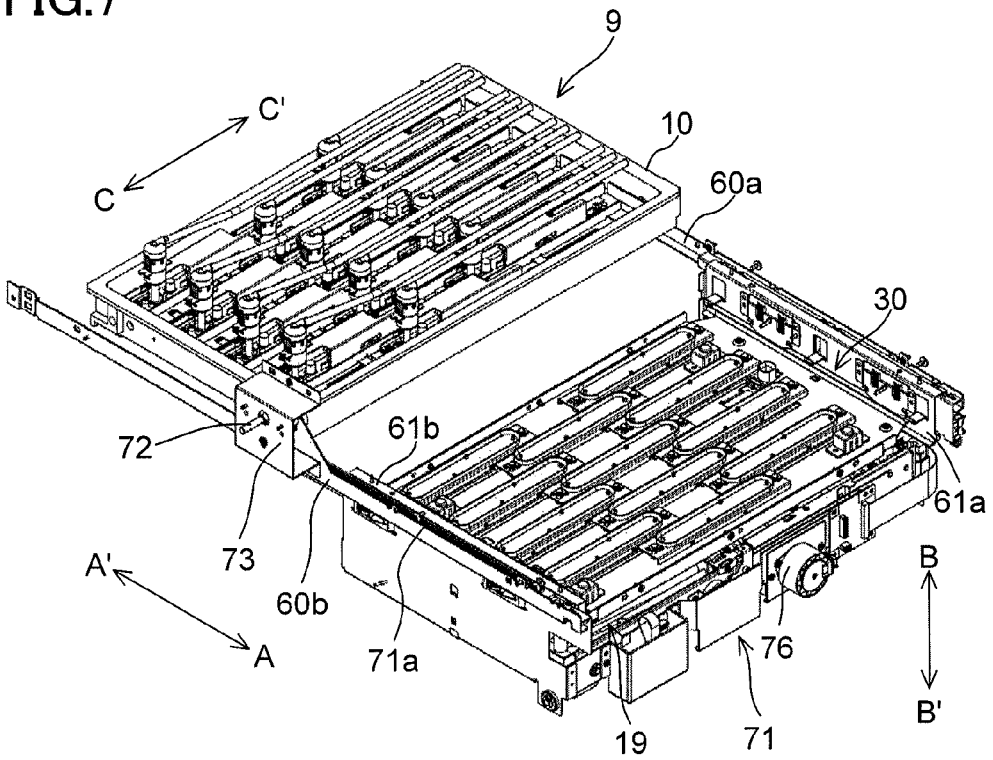
FIG. 7 is a perspective view showing structures of the recording portion, a cap unit, and a wipe unit of the printer according to the embodiment of the present disclosure.

As shown in FIG. 7, two guide rails 60*a*, 60*b* are fixed under the recording portion 9 along both end portions parallel with the sheet conveyance direction (arrow A direction). A pair of guide plates 61*a*, 61*b* are fixed to the guide rails 60*a*, 60*b*, respectively, and side end edges of the cap unit 30 are supported on lower end portions of the guide plates 61*a*, 61*b*. Besides, a carriage 71 is slidably supported by the guide rails 60*a*, 60*b*, and the wipe unit 19 is mounted on the carriage 71.

The cap unit 30 can reciprocate between a first position right under the recording portion 9 and a second position (position in FIG. 7) evacuated from the first position in a horizontal direction (arrow A direction), and is structured to move upward at the first position to cap the recording heads 17*a*-17*c*.

Figure 8:
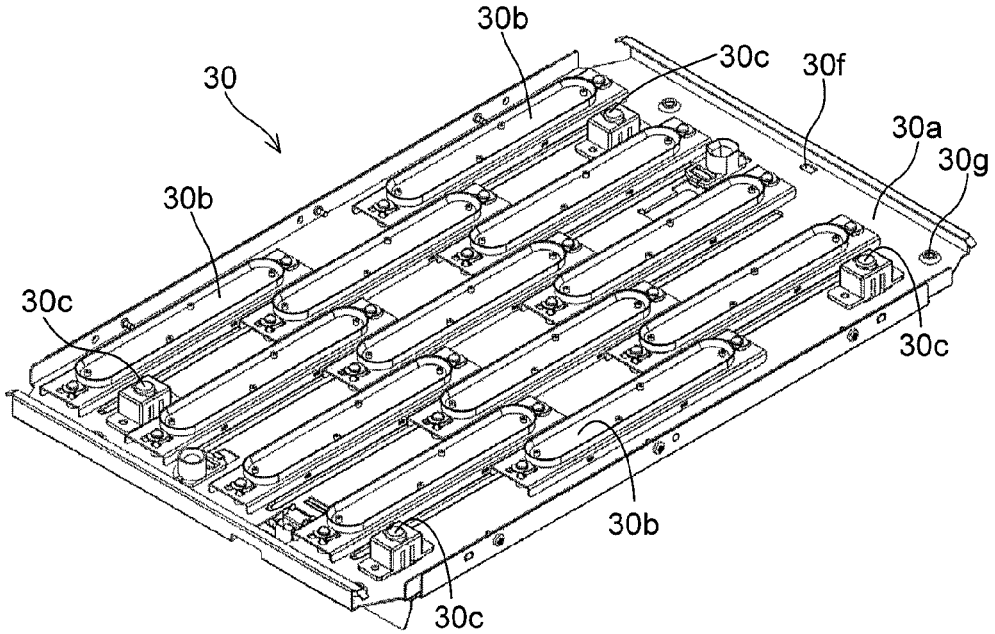
FIG. 8 is a perspective view showing a structure of the cap unit of the printer according to the embodiment of the present disclosure.

Specifically, as shown in FIG. 8, the cap unit 30 includes a sheet-metal cap tray 30*a*, 12 concave-like cap portions 30*b* disposed on an upper surface of the cap tray 30, and 4 height-direction positioning protrusions 30*c*.

The cap portions 30*b* are disposed at positions corresponding to the recording heads 17*a*-17*c*. According to this, the cap unit 30 moves upward at the first position, whereby each cap portion 30*b* caps the ink ejecting surface F of each recording head 17*a*-17*c*. When the cap unit 30 is moved up toward the recording portion 9 to cap the recording heads 17*a*-17*c*, the height-direction positioning protrusion 30 contacts the housing 10 of the recording head 9 and thereby keeps a constant contact state between the cap portion 30*b* and the ink ejecting surface F.

Figure 9:
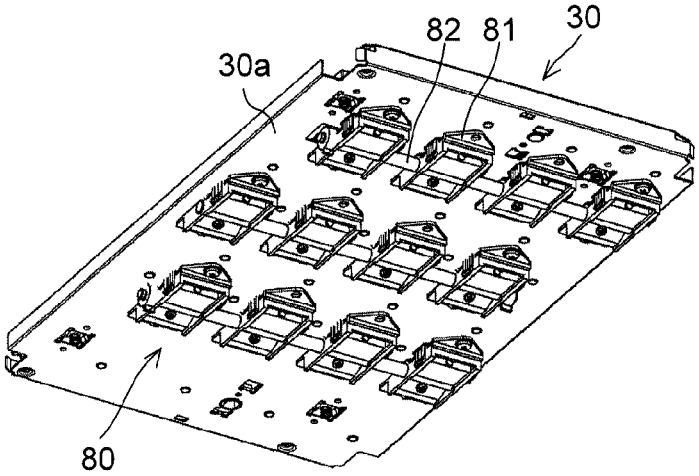
FIG. 9 is a perspective view showing, from below, structures of the cap unit and a cleaning mechanism of the printer according to the embodiment of the present disclosure.

Besides, as shown in FIG. 9, a cleaning mechanism 80 described later is screwed to a lower surface of the cap unit 30.

As shown in FIG. 7, the wipe unit 19 can reciprocate between the first position right under the recording portion 9 and the second position evacuated from the first position in the horizontal direction (arrow A direction), and is structured to move upward at the first position to perform a wiping operation described later.

Specifically, a drive motor 72 for moving the carriage 71 in an AA' direction, a line of gears (not shown) engaging with the drive motor 72 and rack teeth 71*a* of the carriage 71, and a cover member 73 for covering them are mounted outside the guide rail 60*b*. The drive motor 72 rotates forward, whereby the line of gears rotate, and the carriage 71 and the wipe unit 19 move from the second position to the first position. In the meantime, the drive motor 72, the line of gears and the like compose a wipe moving mechanism that moves the wipe unit 19 in the horizontal direction.

Figure 10:
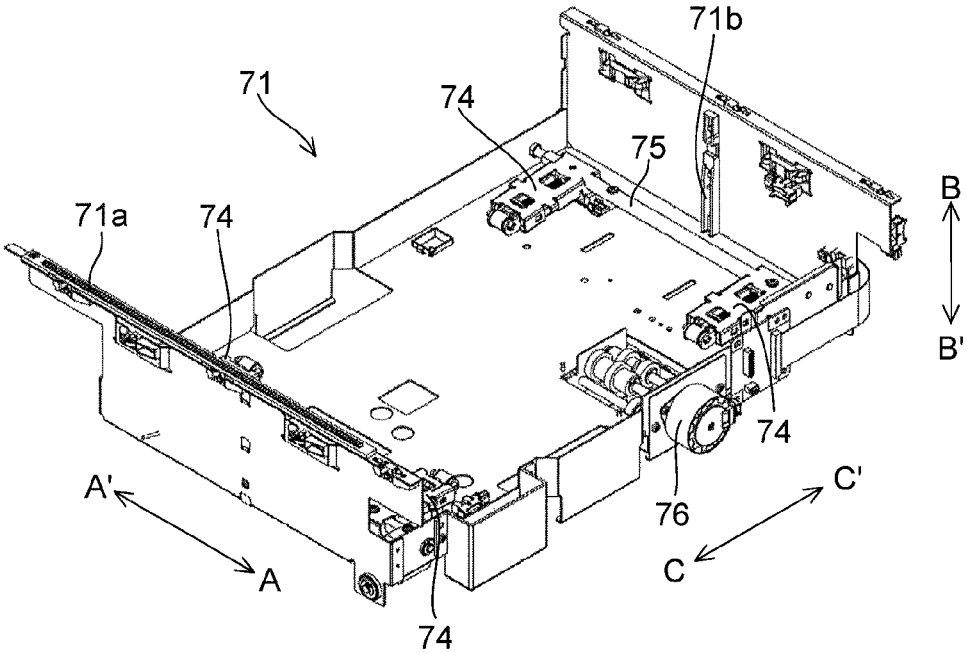
FIG. 10 is a perspective view showing a structure of a carriage of the printer according to the embodiment of the present disclosure.
Figure 11:
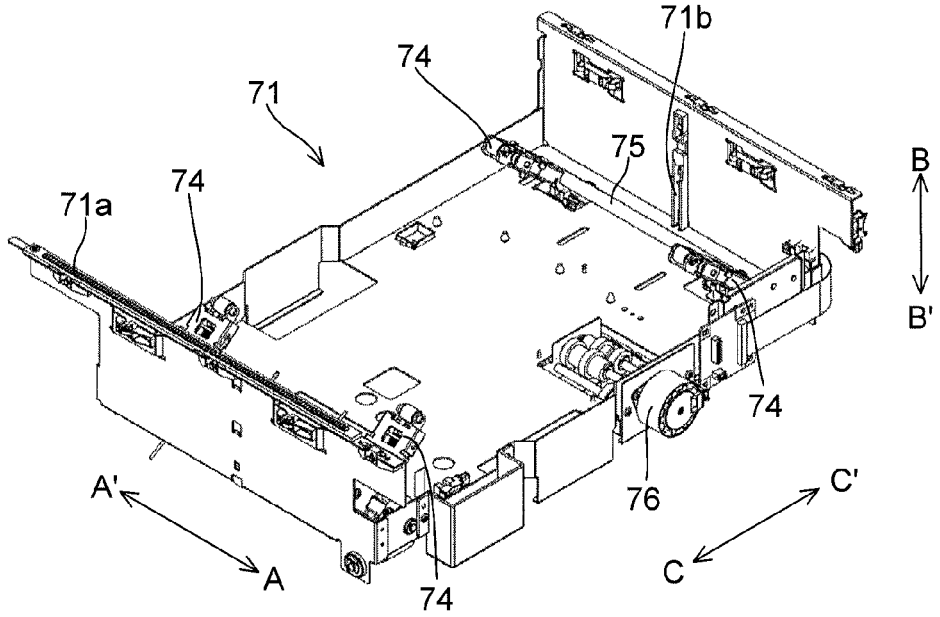
FIG. 11 is a perspective view showing the structure of the carriage of the printer according to the embodiment of the present disclosure.

Besides, as shown in FIG. 10 and FIG. 11, at four corners of the carriage 71, support arms 74 are disposed which support the wipe unit 19 from a lower surface side and are swingable (rise and fall). The support arms 74 adjacent in the AA' direction are connected to each other by a rotary shaft 75. Besides, a wipe moving-up/down motor 76 for swinging the support arms 74, a line of gears that engage with gears of the wipe moving-up/down motor 76 and rotary shafts 75 and the like (not shown) are mounted outside the carriage 71. The wipe moving-up/down motor 76 rotates forward, whereby the line of gears rotate, and the rotary shafts 75 rotate, whereby the support arms 74 swing (rise). In this way, wipe unit 19 moves up. In the meantime, the wipe moving-up/down motor 76, the line of gears, the rotary shafts 75, the support arms 74 and the like compose a wipe moving-up/down mechanism that moves the wipe unit 19 in a vertical direction (arrow BB' direction). Besides, an inner surface of the carriage 71 is provided with guide grooves 71*b* which extend in the vertical direction, and the wipe unit 19 moves up and down along the guide grooves 71*b*.

Figure 12:
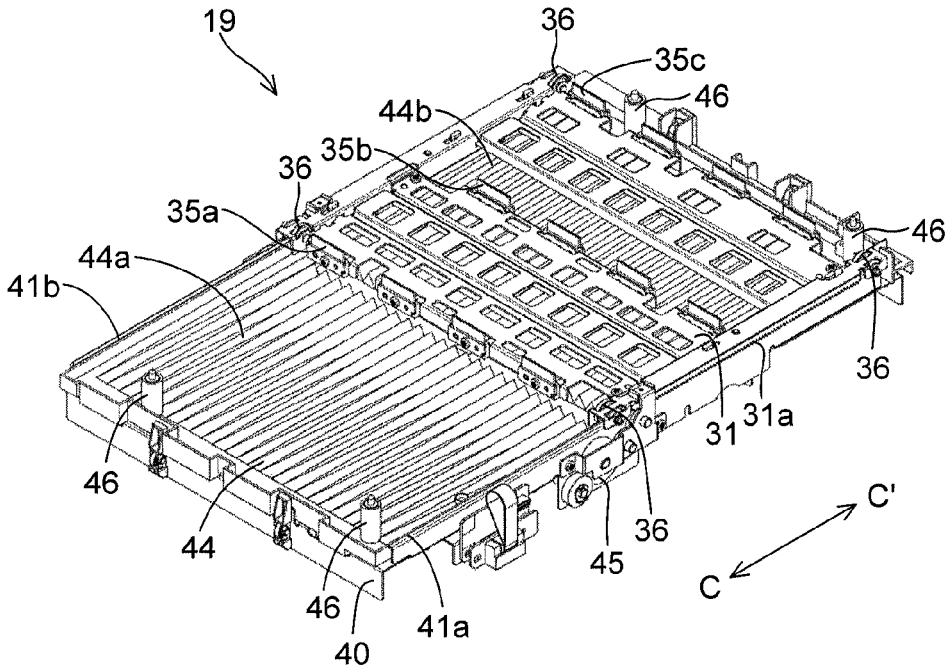
FIG. 12 is a perspective view showing the structure of the wipe unit of the printer according to the embodiment of the present disclosure.
Figure 13:
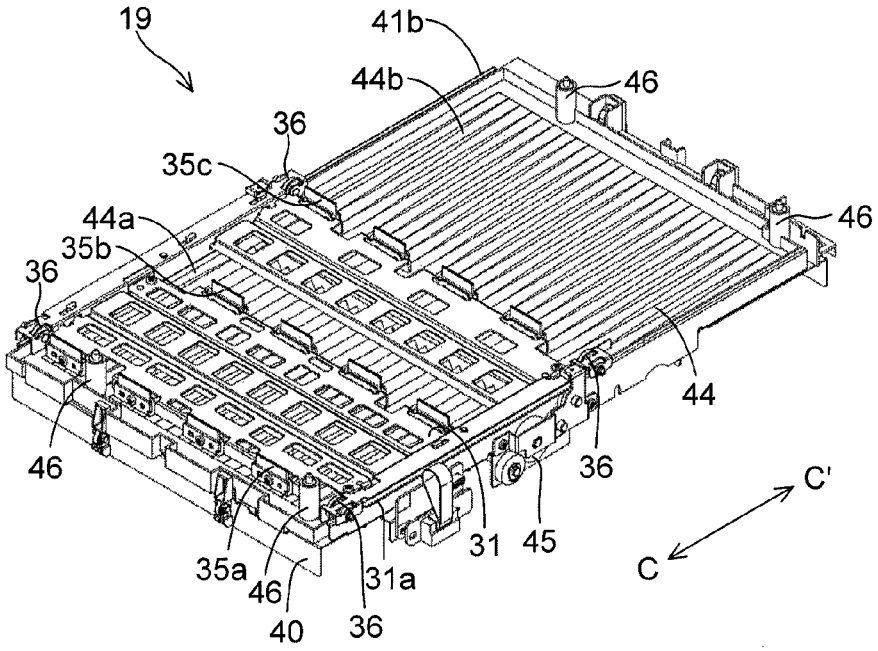
FIG. 13 is a perspective view showing the structure of the wipe unit of the printer according to the embodiment of the present disclosure.

As shown in FIG. 12 and FIG. 13, the wipe unit 19 is composed of a substantially rectangular wiper carriage 31 to which a plurality of wipers (wipe blades) 35*a*-35*c* are fixed and a support frame 40 that supports the wiper carriage 31.

Opposing end edges of an upper surface of the support frame 40 are provided with rail portions 41*a*, 41*b*, and rollers 36 disposed at four corners of the wiper carriage 31 contact the rail portions 41*a*, 41*b*, whereby the wiper carriage 31 is supported slidably in an arrow CC' direction by the support frame 40.

A wiper carriage moving motor 45 for moving the wiper carriage 31 in a horizontal direction (arrow CC' direction), and a line of gears (not shown) that engage with the wiper carriage moving motor 45 and rack teeth (not shown) of the wiper carriage 31 are mounted outside the support frame 40. The wiper carriage moving motor 45 rotates forward and backward, whereby the line of gears rotate forward and backward and the wiper carriage 31 reciprocates in the horizontal direction (arrow CC' direction). In the meantime, the wiper carriage moving motor 45, the line of gears and the like compose a wipe slide mechanism that moves the wipers 35*a*-35*c* along the ink ejecting surfaces F of the recording heads 17*a*-17*c*.

The wipers 35*a*-35*c* are each a rubber member formed of EPDM, for example, for wiping the ink pushed out from the ejecting nozzles 18 of each recording head 17*a*-17*c*. The wipers 35*a*-35*c* are pressed, from a substantially vertical direction, against a wipe start position located outside the nozzle region R (see FIG. 5) from which a nozzle surface of the ejecting nozzle 18 is exposed, wipe the ink ejecting surface F including the nozzle regions R in a predetermined direction (arrow C direction in FIG. 12) by means of the movement of the wiper carriage 31.

The four wipers 35*a* are disposed at equal intervals, likewise, also the four wipers 35*b* and the four wipers 35*c* are disposed at equal intervals. The wipers 35*a*, 35*c* are disposed at positions corresponding to the left and right recording heads 17*a*, 17*c* (see FIG. 3) that compose each line head 11C-11K. Besides, the wiper 35*b* is disposed at a position corresponding to the central recording head 17*b* (see FIG. 3) that composes each line head 11C-11K, and is deviated and fixed, with respect to the wipers 35*a*, 35*c*, by a predetermined distance in a direction perpendicular to the moving direction (arrow CC' direction) of the wiper carriage 31.

In the meantime, near the wipers 35*a*-35*c*, engagement pieces 47 (see FIG. 20) are disposed which engage with later-described levers 86 of the cleaning mechanism 80.

Height-direction positioning protrusions 46 are disposed at four places of the upper surface of the support frame 40. When the support frame 40 is moved up toward the recording portion 9 to perform the wipe operation for the ink ejecting surfaces F of the recording heads 17*a*-17*c* by means of the wipers 35*a*-35*c*, the height-direction positioning protrusions 46 contact the housing 10 of the recording head 9 and thereby keep a constant contact state between the wipers 35*a*-35*c* and the ink ejecting surfaces F.

The upper surface of the support frame 40 is provided with an ink collection tray 44 for collecting the waste ink that is wiped from the ink ejecting surfaces F by the wipers 35*a*-35*c* and collected by the cleaning mechanism 80. A substantially central portion of the ink collection tray 44 is provided with an ink discharge hole (not shown) and tray surfaces 44*a*, 44*b* on both sides of the ink discharge hole have a downward gradient toward the ink discharge hole. The waste ink, which is wiped from the ink ejecting surfaces F by the wipers 35*a*-35*c* and falls onto the tray surfaces 44*a* and 44*b*, flows to the ink discharge hole. Thereafter, the waste ink is collected by a waste ink collection tank 49 (see FIG. 25) via an ink collection path 48 (see FIG. 25) that is connected to the ink discharge hole.

Figure 14:
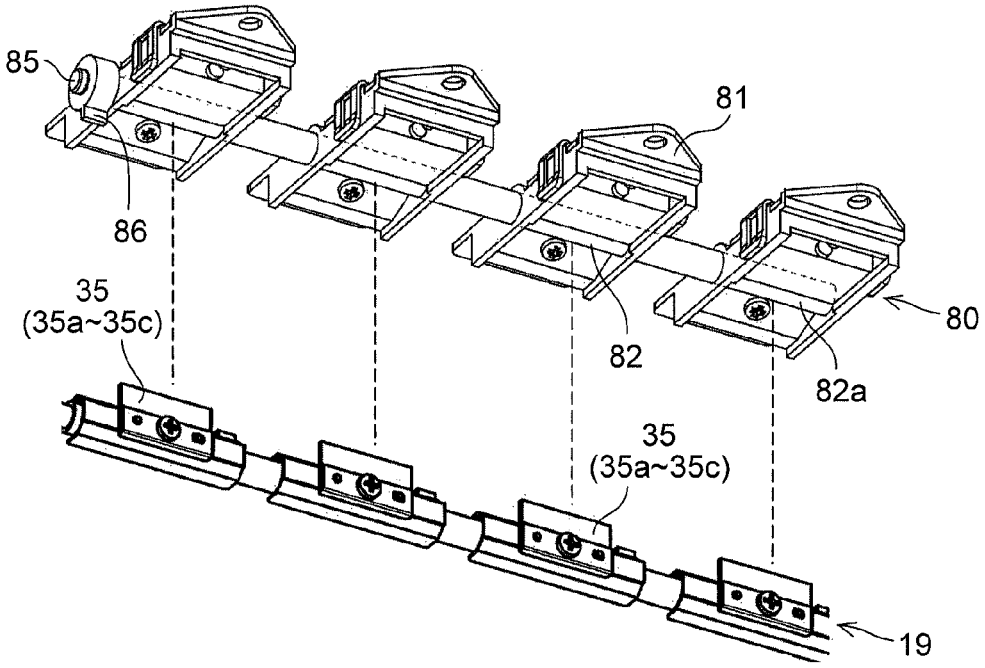
FIG. 14 is a perspective view showing, from below, a state in which the wipe unit is positioned under the cleaning mechanism of the printer according to the embodiment of the present disclosure.
Figure 15:
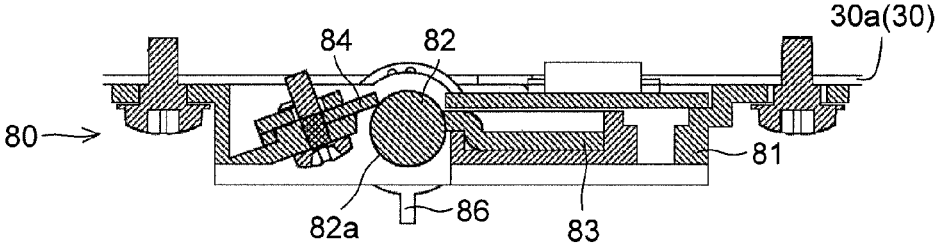
FIG. 15 is a side cross-sectional view showing the structure of the cleaning mechanism of the printer according to the embodiment of the present disclosure.

As shown in FIG. 9, FIG. 14, and FIG. 15, the cleaning mechanism 80 includes 12 main body portions 81 screwed to the lower surface of the cap unit 30, cleaning members 82, moisturizing members 83, and cleaning blades 84.

The main body portions 81 are disposed at positions corresponding to the wipers 35 (35*a*-35*c*).

The cleaning member 82 is disposed one for each of the four main body portions 81, and is supported rotatably by the main body portions 81. The cleaning member 82 is a roller member and is structured in such a manner that the ink 22 adhering to a tip end surface 35*d* (see FIG. 26) of the wiper 35 is transferred. As the cleaning member 82, for example, a steel roller whose surface is plated by nickel, a stainless roller, an aluminum roller, or a material obtained by applying an anodizing process to a surface of the aluminum roller is used. Besides, as shown in FIG. 14, the lever 86, which rotates the rotary shaft 85 in only one direction via a one-way clutch (not shown), is disposed on one end portion of the rotary shaft 85 of the cleaning member 82 to protrude downward. The rotary shafts 85 rotate, whereby outer circumferential surfaces (transfer surfaces 82*a*) of the cleaning members 82 move (rotate). In the meantime, the wipe slide mechanism, the engagement pieces 47, and the levers 86 compose a transfer surface 82*a* moving mechanism that moves (rotates) the transfer surfaces 82*a* in such a manner that the tip end surfaces 35*d* of the wipers 35 contact clean portions of the transfer surfaces 82*a* of the cleaning members 82.

As shown in FIG. 15, the moisturizing member 83 is disposed in an upstream side (upstream side of the cleaning member 82 in the rotation direction) of the cleaning blade 84. The moisturizing member 83 is formed of a material such as a porous material, a nonwoven fabric or the like that has good liquid absorption, and is impregnated with drying restrainer (moisturizing liquid such as glycerin or the like) that does not evaporate easily. The moisturizing member 83 contacts the transfer surface 82*a* of the cleaning member 82 to apply the drying restrainer, whereby the drying of the ink 22 transferred to the transfer surface 82*a* of the cleaning member 82 is alleviated.

The cleaning blade 84 is disposed to contact the transfer surface 82*a* of the cleaning member 82 and removes the ink 22 transferred to the transfer surface 82*a* of the cleaning member 82. In this way, it is possible to force the tip end surface 35*d* of the wiper 35 to contact the clean portion of the transfer surface 82*a*.

Next, a recovery operation of the recording heads 17*a*-17*c* of the printer 100 according to the present embodiment is described.

Figure 16:
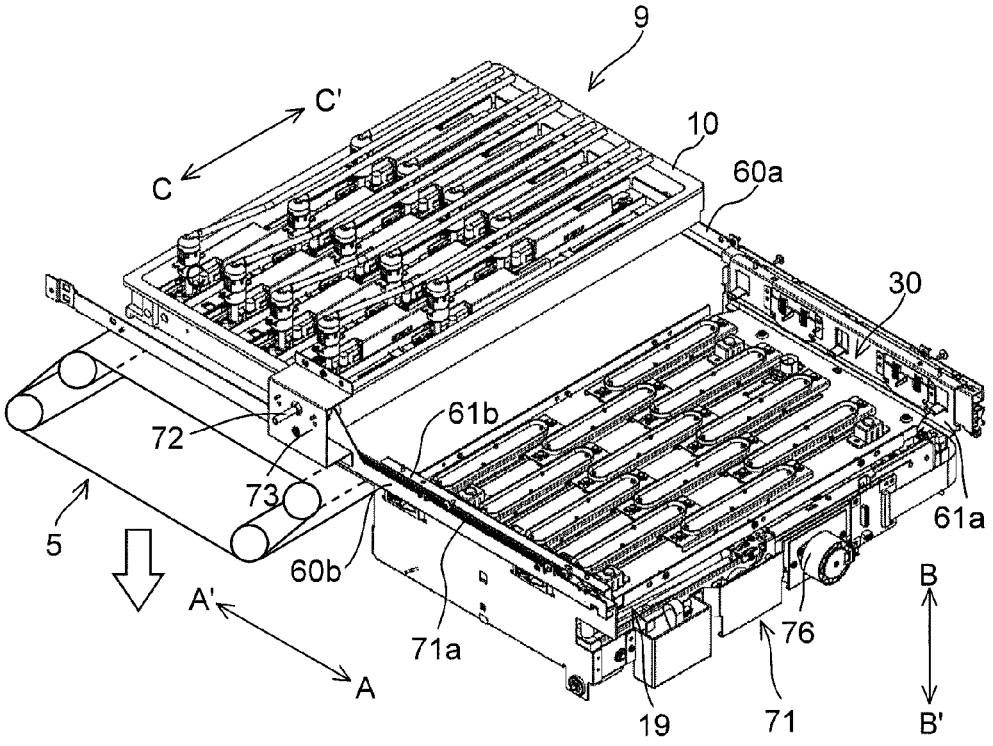
FIG. 16 is a perspective view showing a state in which the first belt conveyance portion of the printer moves down according to the embodiment of the present disclosure.
Figure 17:
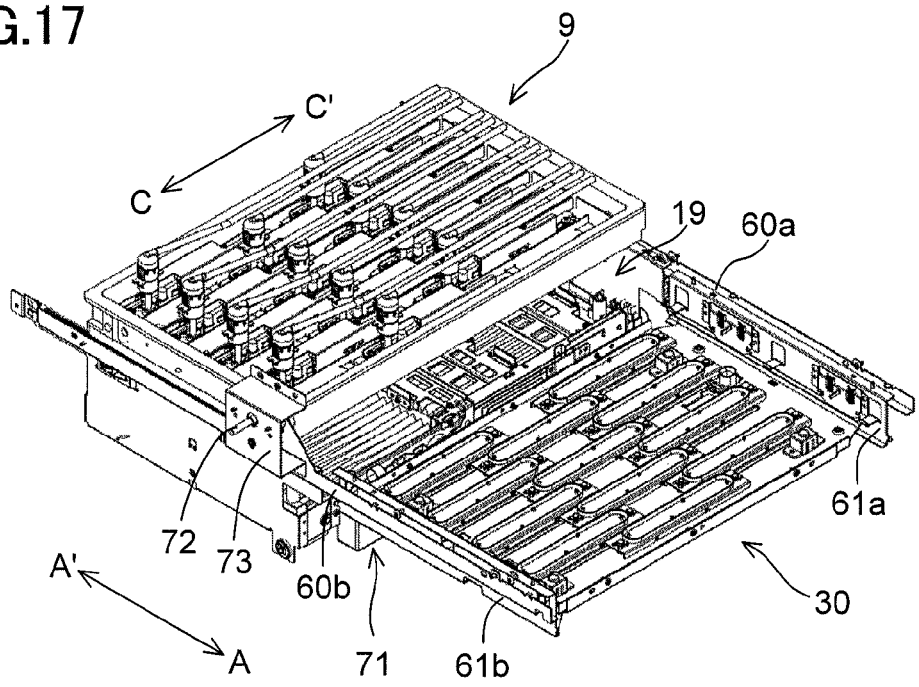
FIG. 17 is a perspective view showing a state in which the wipe unit of the printer according to the embodiment of the present disclosure moves to a first position.

In a case where a recovery process of the recording heads 17*a*-17*c* is performed by means of the wipe unit 19, as shown in FIG. 16, a control portion 90 (see FIG. 1) moves down the first belt conveyance portion 5 that is disposed to oppose a lower surface of the recording portion 9. And, as shown in FIG. 17, the control portion 90 controls the wipe moving mechanism with the cap unit 30 left at the second position and thereby moves the wipe unit 19 from the second position to the first position.

And, prior to the wiping operation, the control portion 90 closes the inlet valve 27 (see FIG. 6) in a state where printing is not performed by the recording heads 17*a*-17*c*, and presses the syringe pump 21 (see FIG. 6), whereby the ink 22 in the cylinder 21*a* is supplied to the recording heads 17*a*-17*c* through the second supply path 25. The supplied ink 22 is forcibly discharged (purged) from the ejecting nozzles 18. Because of this purge operation, thickened ink, foreign matter, and air bubbles in the ejecting nozzles 18 are discharged, and the recording heads 17*a*-17*c* can be recovered.

Figure 18:
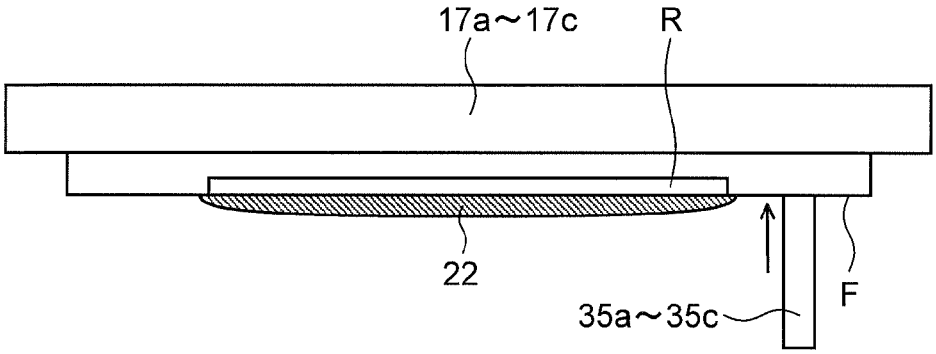
FIG. 18 is a side cross-sectional view showing a state in which a wiper of the printer according to the embodiment of the present disclosure is pressed against a wipe start position of the ink ejecting surface of the recording head.

Next, the wiping operation for wiping the ink 22 discharged to the ink ejecting surface F is performed. Specifically, as shown in FIG. 18, the control portion 90 controls the wipe moving-up/down mechanism to move up the wipe unit 19 and thereby presses the wipers 35*a*-35*c* against the wipe start positions of the ink ejecting surfaces F of the recording heads 17*a*-17*c*.

Figure 19:
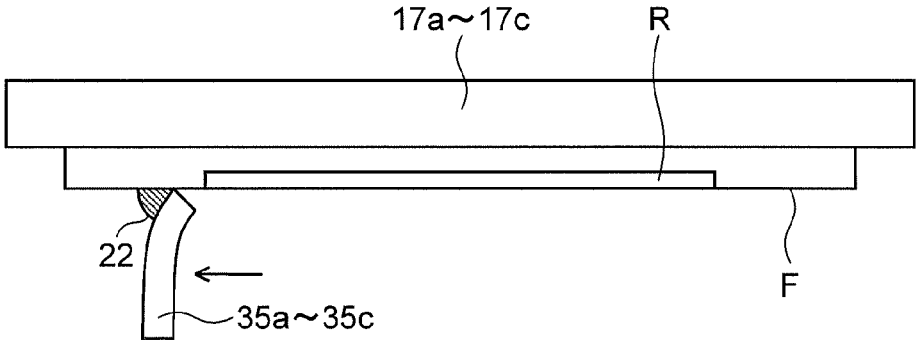
FIG. 19 is a side cross-sectional view showing a state in which purged ink ejected to the ink ejecting surface of the recording head is being wiped by the wiper of the printer according to the embodiment of the present disclosure.

And, the control portion 90 controls the wiper carriage moving motor 45 (see FIG. 12) to move the wiper carriage 31 horizontally in the C direction, whereby the wipers 35*a*-35*c* wipe the ink 22 pushed out to the ink ejecting surfaces F of the recording heads 17*a*-17*c* as shown in FIG. 19.

After the wipers 35*a*-35*c* move to a downstream-side end portion of the ink ejecting surfaces F of the recording heads 17*a*-17*c*, the control portion 90 controls the wipe moving-up/down mechanism to move down the wiper carriage 31. In this way, the wipers 35*a*-35*c* are evacuated downward from the ink ejecting surfaces F of the recording heads 17*a*-17*c*.

Figure 20:
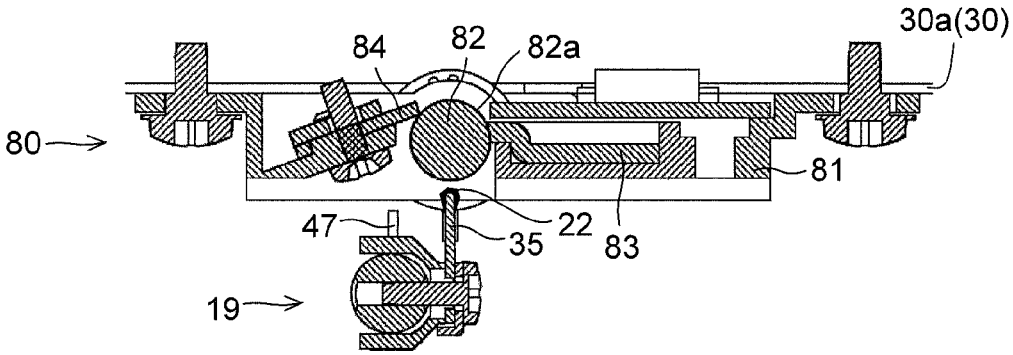
FIG. 20 is a side cross-sectional view showing a state in which the wiper of the printer according to the embodiment of the present disclosure is positioned right under a cleaning member.

Thereafter, the control portion 90 controls the wipe moving mechanism to move the wipe unit 19 from the first position to the second position. In this way, as shown in FIG. 20, wipers 35 (35*a*-35*c*) are disposed right under the cleaning members 82 of the cleaning mechanism 80.

Figure 21:
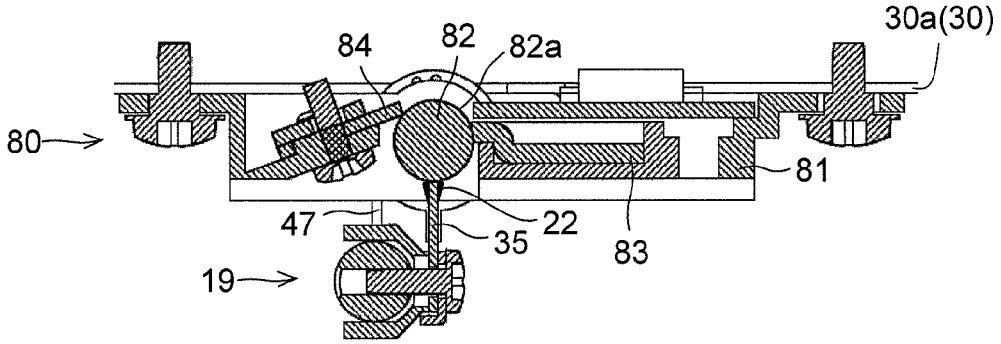
FIG. 21 is a side cross-sectional view showing a state in which the wiper of the printer according to the embodiment of the present disclosure is pressed against a transfer surface of the cleaning member.

And, as shown in FIG. 21, the control portion 90 controls the wipe moving-up/down mechanism to move up the wipe unit 19, whereby the wipers 35 contact substantially vertically the transfer surfaces 82*a* (outer circumferential surfaces) of the cleaning members 82.

Figure 22:
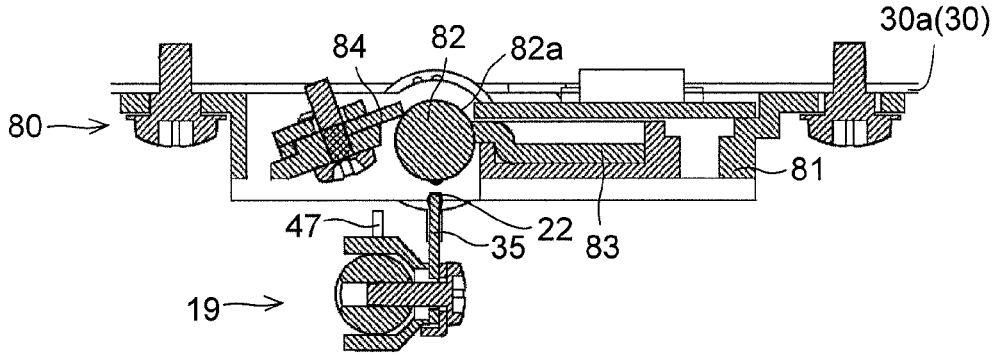
FIG. 22 is a side cross-sectional view showing a state in which the wiper of the printer according to the embodiment of the present disclosure is located away from the transfer surface of the cleaning member.

Thereafter, as shown in FIG. 22, the control portion 90 controls the wipe moving-up/down mechanism to move down the wipe unit 19, whereby the wipers 35 leave the transfer surfaces 82*a* of the cleaning members 82. In this way, at least part of the ink 22 on the tip end surfaces 35*d* of the wipers 35 are transferred onto the transfer surfaces 82*a* of the cleaning members 82.

Figure 23:
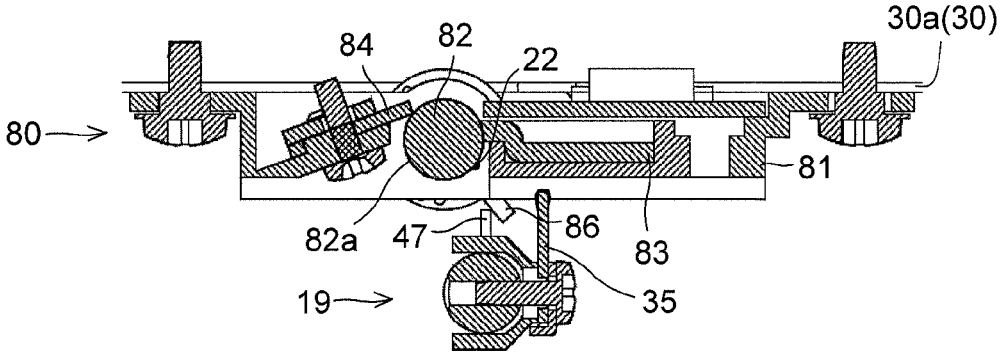
FIG. 23 is a side cross-sectional view showing a state in which an engagement piece of the wipe unit of the printer according to the embodiment of the present disclosure engages with a lever of the cleaning mechanism to rotate the cleaning member.

Next, as shown in FIG. 23, the control portion 90 controls the wiper carriage moving motor 45 (see FIG. 12) to move the wipers 35 in a horizontal direction (right direction of FIG. 23). At this time, the engagement pieces 47 of the wipe unit 19 engage with the levers 86 of the cleaning mechanism 80, and the cleaning members 82 rotate in a counterclockwise direction, whereby the clean portions of the transfer surfaces 82*a* of the cleaning members 82 are positioned at the lowermost portions.

Figure 24:
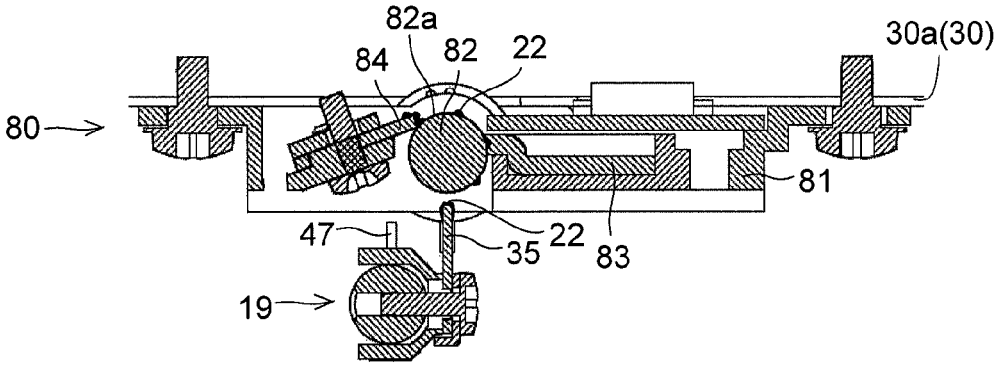
FIG. 24 is a side cross-sectional view showing a state in which the wiper of the printer according to the embodiment of the present disclosure is returned under the cleaning member and thereby the lever returns to an original position.

And, as shown in FIG. 24, the control portion 90 controls the wiper carriage moving mechanism 45 to return the wipers 35 under the cleaning members 82. In the meantime, because the levers 86 are biased in a clockwise direction by not-shown bias members, also the levers 86 return to the original positions.

Thereafter, as shown in FIG. 21, the control portion 90 controls the wipe moving-up/down mechanism to force the wipers 35 to contact substantially vertically the transfer surfaces 82*a* of the cleaning members 82. At this time, the tip end surfaces 35*d* of the wipers 35 contact the clean portions of the transfer surfaces 82*a*. And, as shown in FIG. 22, the control portion 90 controls the wipe moving-up/down mechanism to force the wipers 35 to leave the transfer surfaces 82*a* of the cleaning members 82. Besides, as shown in FIG. 23 and FIG. 24, the wipers 35 are reciprocated in the horizontal direction, and the cleaning members 82 are rotated.

Figure 25:
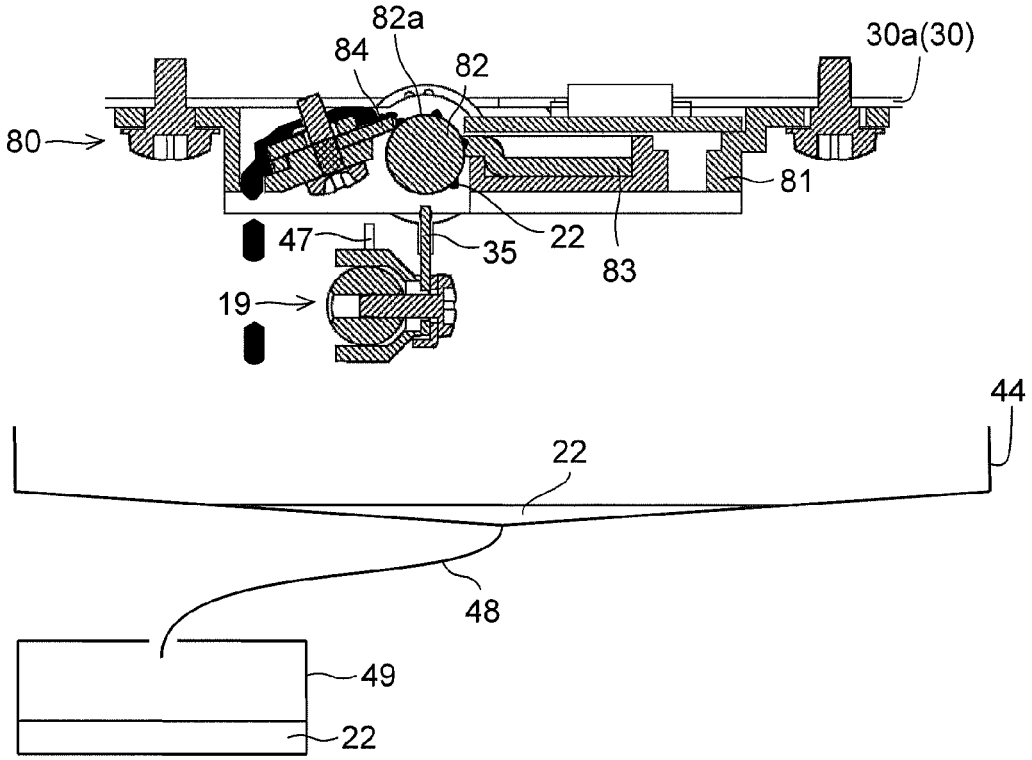
FIG. 25 is a side cross-sectional view showing a state in which ink on the tip end surface of the wiper of the printer according to the embodiment of the present disclosure is removed.

In this way, it is repeated about 10 to 50 times to force the wipers 35 to substantially vertically contact and leave the transfer surfaces 82*a* of the cleaning members 82. In this way, as shown in FIG. 25, the ink 22 on the tip end surfaces 35*d* of the wipers 35 is removed until the ink 22 is not transferred onto the cleaning members 82.

Besides, the cleaning members 82 rotate, whereby the drying restrainer is applied by the moisturizing members 83 onto the transfer surfaces 82*a* of the cleaning members 82 and the ink 22 on the transfer surfaces 82*a* is collected by the cleaning blades 84. Besides, the waste ink collected by the cleaning blades 84 is collected into the ink collection tray 44 and collected into the waste ink collection tank 49 via the ink collection path 48.

Figure 26:
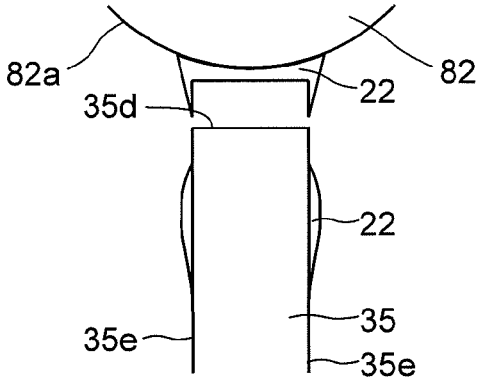
FIG. 26 is a side cross-sectional view showing a state in which ink, which is present on a side surface near the tip end surface of the wiper of the printer according to the embodiment of the present disclosure, is removed with the aid of surface tension.
Figure 27:
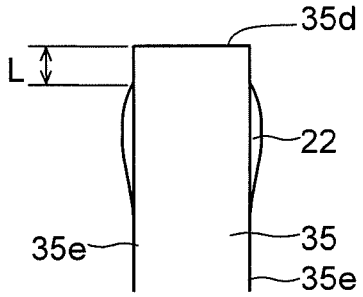
FIG. 27 is a side cross-sectional view showing a state in which ink, which is present on and near the tip end surface of the wiper of the printer according to the embodiment of the present disclosure, is removed.

In the meantime, in the above recovery operation, only the tip end surfaces 35*d* of the wipers 35 are forced to contact the transfer surfaces 82*a* of the cleaning members 82, but as shown in FIG. 26, the ink 22 on side surfaces 35*e* of the wipers 35 near the tip end surfaces 35*d* is also transferred onto the transfer surfaces 82*a* of the cleaning members 82 with the aid of the surface tension of the ink. Because of this, as shown in FIG. 27, on the side surface 35*e* of the wiper 35, the ink 22 on a portion within a predetermined distance L=about 0.5 mm from the tip end surface 35*d* of the wiper 35 is removed.

Figure 28:
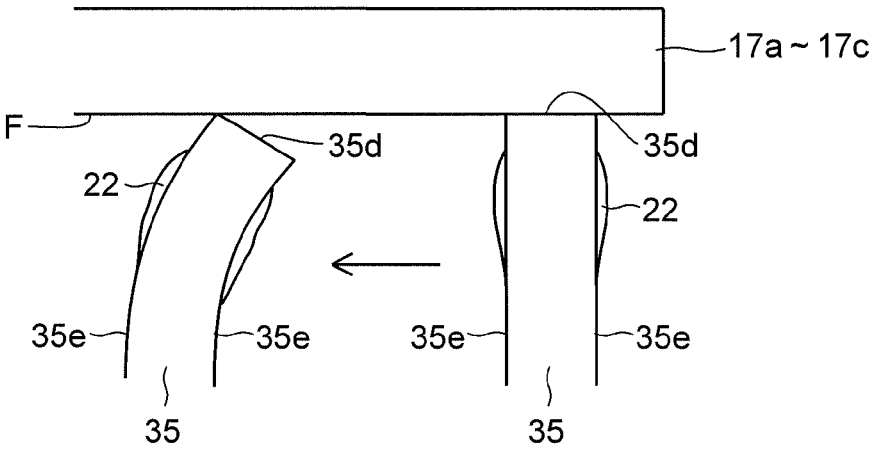
FIG. 28 is a side cross-sectional view showing a state in which the wiper of the printer according to the embodiment of the present disclosure contacts the ink ejecting surface of the recording head, thereafter, starts wiping.

As a result of this, as shown in FIG. 28, during the next recovery process, it is possible to alleviate the ink 22 on the side surfaces 35*e* of the wipers 35 adhering to the ink ejecting surfaces F of the recording heads 17*a*-17*c*.

Next, the operation of mounting the cap unit 30 onto the recording heads 17*a*-17*c* of the printer 100 according to the present embodiment is described.

Figure 29:
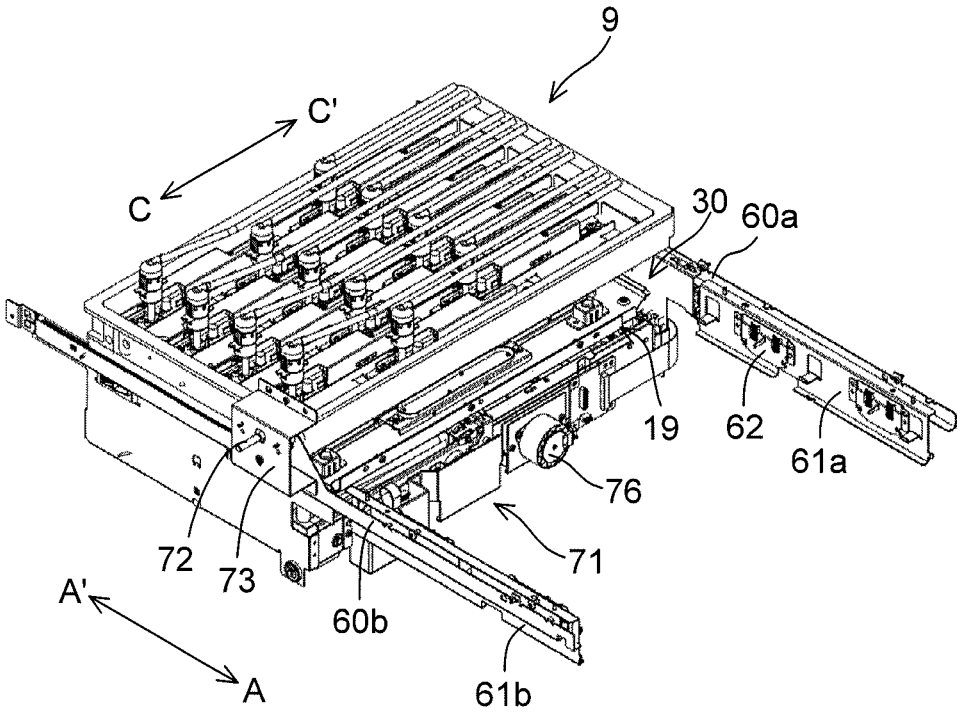
FIG. 29 is a perspective view showing a state in which the cap unit and the wipe unit of the printer according to the embodiment of the present disclosure move to the first position.

In the case where the recording heads 17*a*-17*c* are capped by the cap unit 30, as shown in FIG. 16, the control portion 90 moves down the first belt conveyance portion 5 disposed to oppose the lower surface of the recording portion 9. And, as shown in FIG. 29, the control portion 90 controls the wipe moving mechanism to move the wipe unit 19 and the cap unit 30 from the second position to the first position with the cap unit 30 disposed on the wipe unit 19. Thereafter, the control portion 90 controls the wipe moving-up/down mechanism to move up the wipe unit 19 and the cap unit 30 and thereby mounts the cap unit 30 onto the recording heads 17*a*-17*c*.

In the present embodiment, as described above, the transfer surface 82*a* moving mechanism (wiper carriage moving motor 45, engagement piece 47, lever 86 and the like) moves the transfer surface 82*a* in such a manner that the tip end surface 35*d* of the wiper 35 contacts the clean portion of the transfer surface 82*a*. In this way, it is possible to alleviate the ink 22 returning from the transfer surface 82*a* of the cleaning member 82 to the wiper 35.

Besides, the wipe moving-up/down mechanism (support arm 74, rotary shaft 75, wipe moving-up/down motor 76 and the like) repeats a plurality of times to force the wiper 35 to contact and leave the transfer surface 82*a* of the cleaning member 82. In this way, it is possible to surely remove the ink 22 adhering to the tip end surface 35*d* of the wiper 35; accordingly, it is possible to alleviate the ink 22, which adheres to the wiper 35, adhering to the ink ejecting surfaces F of the recording heads 17*a*-17*c* during the next recovery process. As a result of this, it is possible to alleviate the ink ejecting surfaces F of the recording heads 17*a*-17*c* being smeared. In the meantime, if it is only one time to force the wiper 35 to contact and leave the transfer surface 82*a* of the cleaning member 82, the ink 22 remains on the tip end surface 35*d* of the wiper 35.

Besides, the wiper 35 is forced to contact and leave the transfer surface 82*a* of the cleaning member 82 substantially vertically. In this way, not only it is possible to transfer the ink 22 present on the tip end surface 35*d* of the wiper 35 onto the cleaning member 82, but also it is possible to transfer the ink 22 present on the side surface 35*e* of the wiper 35 near the tip end surface 35*d* onto the cleaning member 82 with the aid of the surface tension of the ink. Because of this, during the next recovery process, it is possible to alleviate the ink 22 on the side surface 35*e* of the wiper 35 adhering onto the ink ejecting surfaces F of the recording heads 17*a*-17*c*; accordingly, it is possible to alleviate the ink ejecting surfaces F of the recording heads being smeared.

Besides, as described above, by disposing the cleaning blade 84 for removing the ink 22 transferred to the transfer surface 82*a* of the cleaning member 82, it is possible to clean the transfer surface 82*a* of the cleaning member 82; accordingly, it is possible to easily alleviate the ink 22 returning from the transfer surface 82*a* to the wiper 35. Besides, by using the cleaning member 82 formed of a roller member, it is possible to alleviate the replacement frequency of the cleaning member 82.

Besides, as described above, the cleaning mechanism 80 includes the moisturizing member 83 that applies the drying restrainer, which alleviates the ink 22 on the transfer surface 82*a* being dried, to the transfer surface 82*a* in the upstream side of the cleaning blade 84. In this way, it is possible to alleviate the ink 22 on the transfer surface 82*a* being dried; accordingly, it is possible to alleviate the cleaning blade 84 becoming unable to remove the ink 22 present on the transfer surface 82*a*.

Besides, as described above, the wipe slide mechanism (wiper carriage moving motor 45 and the like) reciprocates the wiper 35, whereby the engagement piece 47 engages with the lever 86 and the rotary shaft 85 rotates in the one direction. In this way, it is possible to easily move the transfer surface 82*a* of the cleaning member 82.

Besides, as described above, by performing the transfer operation of transferring the ink 22 present on the tip end surface 35*d* of the wiper 35 onto the cleaning member 82 at the second position (evacuation position), it is possible to perform the transfer operation during a printing operation. In this way, it is possible to secure an enough time to perform the transfer operation; accordingly, it is possible to continue the transfer operation until the ink 22 on and near the tip end surface 35*d* of the wiper 35 is sufficiently removed.

Besides, as described above, the cleaning mechanism 80 is mounted on the lower surface of the cap unit 30. In this way, it is possible to save the space for disposing the cleaning mechanism 80 and the cap unit 30.

Besides, as described above, when the transfer surface 82*a* is not moved (when the cleaning member 82 is not rotating), the tip end surface 35*d* of the wiper 35 is forced to contact the transfer surface 82*a* of the cleaning member 82. In this way, it is possible to stably force the tip end surface 35*d* of the wiper 35 to surely contact the transfer surface 82*a*. Besides, it is possible to alleviate wear of the wiper 35 and cleaning member 82.

In the meantime, it should be considered that the embodiment disclosed this time is an example in all respects and is not limiting. The scope of the present disclosure is not indicated by the above description of the embodiment but by the claims, and all modifications within the scope of the claims and the meaning equivalent to the claims are covered.

Figure 30:
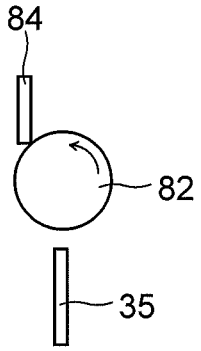
FIG. 30 is a side view showing structures of a cleaning blade and a cleaning member according to a first modification of the present disclosure.

For example, in the above embodiment, as shown in FIG. 15, the example is described in which the cleaning blade 84 is disposed to contact the cleaning member 82 in a counter direction with respect to the rotation direction (counterclockwise direction) of the cleaning member 82. But the present disclosure is not limited to this, and as in a first modification of the present disclosure shown in FIG. 30, the cleaning blade 84 may be disposed to contact the cleaning member 82 in a trail direction with respect to the rotation direction (counterclockwise direction) of the cleaning member 82.

Figure 31:
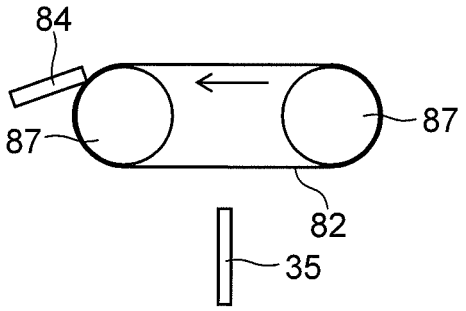
FIG. 31 is a side view showing structures of a cleaning member and a roller according to a second modification of the present disclosure.

Besides, in the above embodiment, the example is described in which the cleaning member 82 is formed of a roller member. But the present disclosure is not limited to this. As in a second modification of the present disclosure shown in FIG. 31, the cleaning member 82 may be formed of a belt member. In this case, either one of rollers 87 disposed on an inner circumferential surface of the cleaning member 82 may be provided with the lever 86 that rotates the rollers 87 in only one direction. In the meantime, as the cleaning member 82, for example, a polyester belt, a rubber belt, or a nickel electroformed belt may be used.

Figure 32:
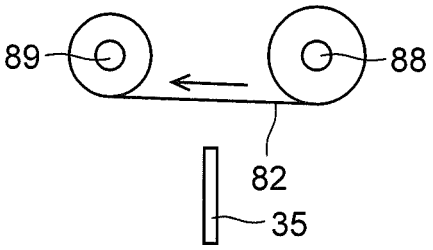
FIG. 32 is a side view showing structures of a cleaning member, a sending roller, and a winding roller according to a third modification of the present disclosure.

Besides, as in a third modification of the present disclosure shown in FIG. 32, the cleaning mechanism 80 may be structured to include a sending roller (sending member) 88 on which the cleaning member 82 is wound, and a winding roller (winding member) 89 that winds the cleaning member 82 sent out from the sending roller 88. In this case, the lever 86 may be disposed on the winding roller 89. Even in the case where the structure as shown in the third modification of the present disclosure is employed, it is possible to force the wiper 35 to contact a clean transfer surface 82*a* supplied from the sending roller 88 and wind a portion of the cleaning member 82, to which the ink 22 is transferred from the wiper 35, by means of the winding roller 89; accordingly, it is possible to easily alleviate the ink 22 returning from the transfer surface 82*a* of the cleaning member 82 to the wiper 35. In the meantime, as the cleaning member 82, it is possible to use a nonwoven fabric or the like. Besides, in the case where the structure as shown in the third modification of the present disclosure is employed, it is unnecessary to dispose the moisturizing member 83 and the cleaning blade 84.

Besides, in the above embodiment, the example is described in which the lever 86 and the engagement piece 47 are disposed, and the transfer surface 82*a* of the cleaning member 82 is moved (rotated) in association with the horizontal movement of the wiper 35. But the present disclosure is not limited to this, and a drive motor may be additionally disposed, and by means of its drive force, the transfer surface 82*a* of the cleaning member 82 may be moved. However, also in this case, when the tip end surface 35*d* of the wiper 35 contacts the transfer surface 82*a* of the cleaning member 82, it is desirable that the transfer surface 82*a* is not moved.

What is claimed is:

1. An ink-jet recording apparatus comprising:

a recording portion that includes a recording head provided with a nozzle region from which an ejection nozzle for ejecting ink onto a recording medium is opened, a wipe unit that includes a wipe blade for wiping purged ink which is forcibly discharged from the ejecting nozzle, a cleaning mechanism that includes a cleaning member having a transfer surface to which ink adhering to a tip end surface of the wipe blade is transferred, a wipe moving-up/down mechanism for moving the wipe blade, a transfer surface moving mechanism for moving the transfer surface, and a control portion, wherein the control portion is capable of:

controlling the wipe moving-up/down mechanism to execute an ink removal step in which the wipe blade repeats a plurality of times contacting and leaving substantially vertically the transfer surface of the cleaning member to remove the ink present on the tip end surface of the wipe blade; and controlling the transfer surface moving mechanism to execute a transfer surface moving step in which the transfer surface moves in such a manner that the tip end surface of the wipe blade contacts a clean portion of the transfer surface;

wherein the wipe unit is able to reciprocate between a first position right under the recording portion and a second position evacuated from the first position in a horizontal direction, and a transfer operation of transferring the ink present on the tip end surface of the wipe blade onto the cleaning member is performed at the second position during a printing operation.

2. The ink-jet recording apparatus according to claim 1, wherein the cleaning member is a roller member or a belt member, the cleaning mechanism includes a cleaning blade that removes the ink transferred to the transfer surface of the roller member or the transfer surface of the belt member, the control portion controls the transfer surface moving mechanism to rotate the roller member or the belt member in such a manner that the tip end surface of the wipe blade contacts the clean portion of the transfer surface, and the roller member or the belt member rotates, whereby the ink transferred to the transfer surface is removed by the cleaning blade.

3. The ink-jet recording apparatus according to claim 2, wherein the cleaning mechanism includes a moisturizing member that applies drying restrainer, which alleviates the ink on the transfer surface drying, to the transfer surface in an upstream side of the cleaning blade in a moving direction of the transfer surface.

4. The ink-jet recording apparatus according to claim 1, wherein the cleaning mechanism includes a sending member on which the cleaning member is wound and a winding member that winds the cleaning member sent out from the sending member, and the control portion controls the transfer surface moving mechanism to rotate the winding member and thereby move the transfer surface of the cleaning member.

5. The ink-jet recording apparatus according to claim 1, further comprising a wipe slide mechanism that moves the wipe blade along an ink ejecting surface of the recording head when wiping the purged ink forcibly discharged from the ejecting nozzle, wherein the cleaning mechanism includes a rotary shaft that moves the transfer surface of the cleaning member and a lever that is disposed on the rotary shaft to rotate the rotary shaft in only one direction, the wipe unit includes an engagement piece that engages with the lever, and the control portion controls the wipe slide mechanism to reciprocate the wipe blade, whereby the engagement piece engages with the lever, the rotary shaft rotates in the one direction, and the transfer surface of the cleaning member moves.

6. The ink-jet recording apparatus according to claim 1, further comprising a cap unit that caps the recording head during a non-printing operation, wherein the cleaning mechanism is mounted on a lower surface of the cap unit.

7. The ink-jet recording apparatus according to claim 1, wherein when the control portion does not control the transfer surface moving mechanism to move the transfer surface, the control portion controls the wipe moving-up/down mechanism to force the tip end surface of the wipe blade to contact the transfer surface of the cleaning member.

8. The ink-jet recording apparatus according to claim 1, wherein at the second position, the wipe blade is arranged right under the cleaning member.

9. The ink-jet recording apparatus according to claim 1, wherein at the second position, the control portion controls the wipe moving-up/down mechanism such that the wipe blade contacts the transfer surface of the cleaning member.

10. The ink-jet recording apparatus according to claim 1, wherein after the wipe blade contacts the transfer surface of the cleaning member, the control portion controls the transfer surface moving mechanism so as to keep the transfer surface stationary, controls the wipe moving-up/down mechanism such that the wipe blade leaves the transfer surface of the cleaning member, and thereafter controls the transfer surface moving mechanism so as to move the transfer surface.

* * * * *